US005659158A

United States Patent [19]

Browning et al.

[11] Patent Number: 5,659,158

[45] Date of Patent: Aug. 19, 1997

[54] SOUND ATTENUATING DEVICE AND INSERT

[75] Inventors: James R. Browning, Berea; Gerald A.. Carek, Vermillion, both of Ohio

[73] Assignee: J. B. Design, Inc., Berea, Ohio

[21] Appl. No.: 390,636

[22] Filed: Feb. 17, 1995

Related U.S. Application Data

[63] Continuation-in-part of Ser. No. 114,156, Sep. 1, 1993, Pat. No. 5,413,189.

[51] Int. Cl.[6] ..... F01N 1/08

[52] U.S. Cl. ..... 181/268; 181/265; 181/275; 181/281

[58] Field of Search ..... 181/251, 257, 181/264, 265, 266, 268, 274, 275, 279, 280, 281, 282, 235

[56] References Cited

U.S. PATENT DOCUMENTS 981,584 1/1911 Miller .
981,770 1/1911 Kreis, Jr. ..... 181/264
4,424,882 1/1984 Moller .
4,643,272 2/1987 Gaffrig .
4,679,597 7/1987 Stein ..... 181/280 X
4,683,978 8/1987 Venter ..... 181/280
4,809,812 3/1989 Flugger .

*Primary Examiner*—Khanh Dang
*Attorney, Agent, or Firm*—Vickers, Daniels & Young

[57] ABSTRACT

A sound attenuating muffler useful with an internal combustion engine, preferably for marine applications, contains an insert comprising an arrangement of annular sound reflecting surfaces defining an inner chamber into which engine exhaust gases flow in a first direction and one or more directors to divert the axial flow of gases and sound waves in a second direction past these sound reflecting surfaces. As the sound waves are reflected off of these surfaces back into the muffler interior, attenuation of the sound is achieved. One or more additional inserts may be placed downstream from the first insert for additional sound attenuation. Each of the inserts may be in the form of discrete sound reflector rings or as a continuous helix. A method of assembling the component parts of the insert is also described.

15 Claims, 11 Drawing Sheets 1
2
2
3
5
6
7
8
9
10
11
12
13
14
15
17a
17b
17c
21
23
23b
24
25
25a
26
27
29
33

FIG. 5A
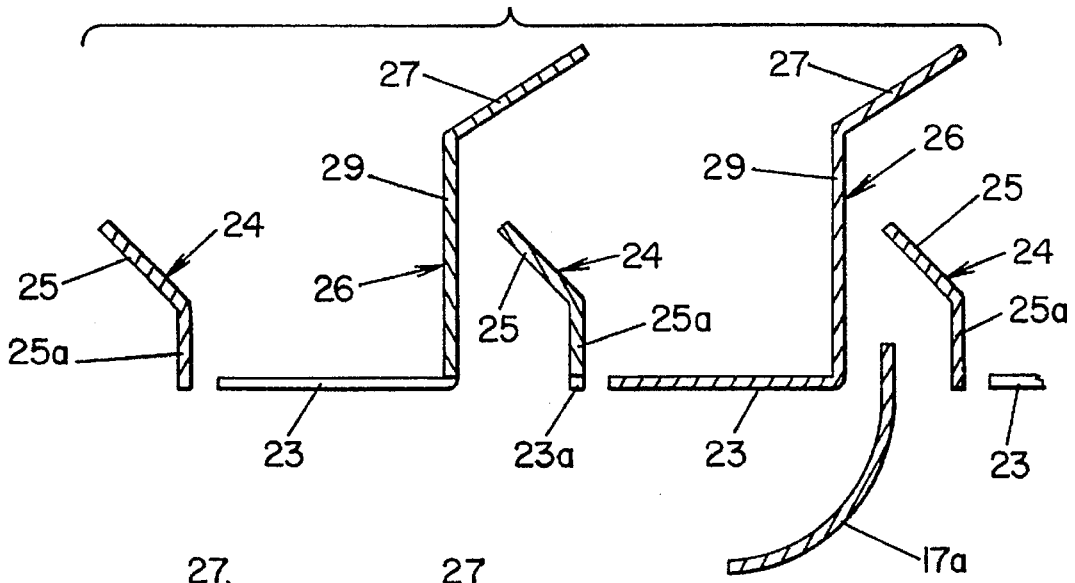
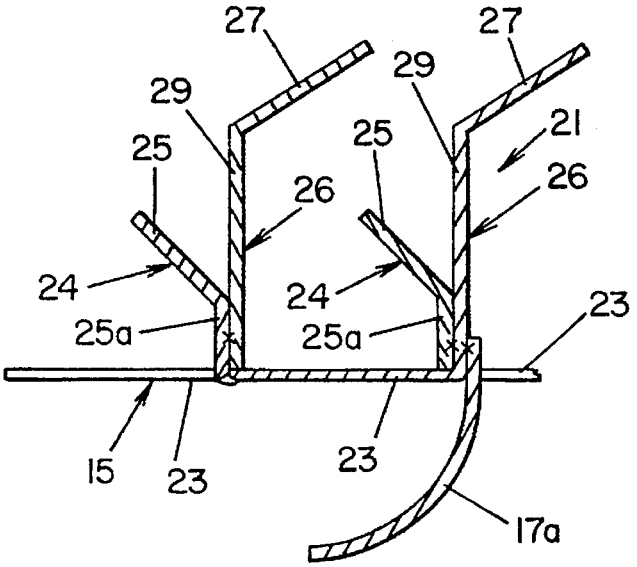
FIG. 5B
FIG. 6A
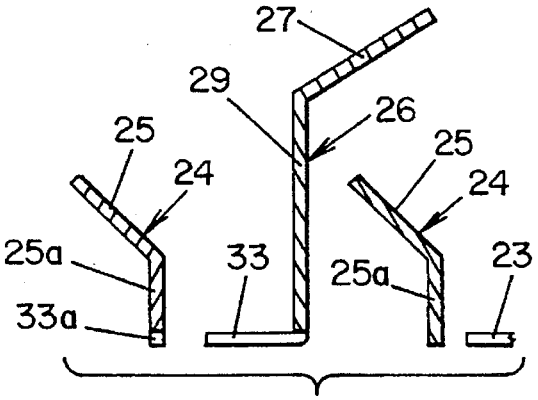
FIG. 6B
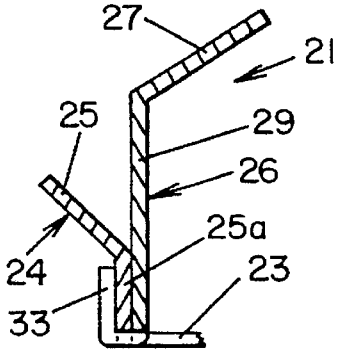

FIG. 13
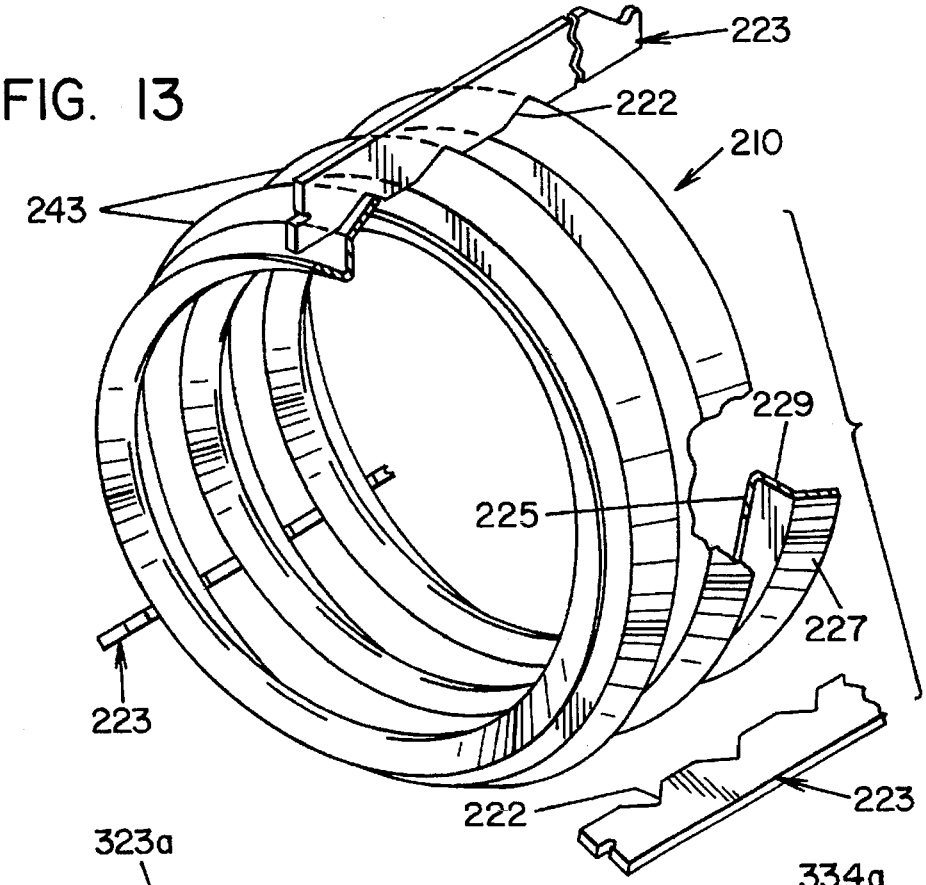
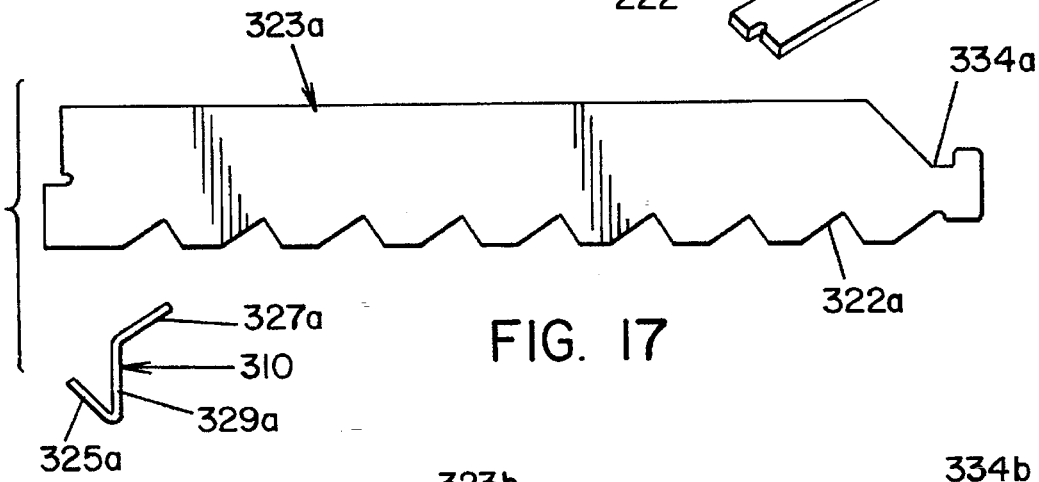
FIG. 17
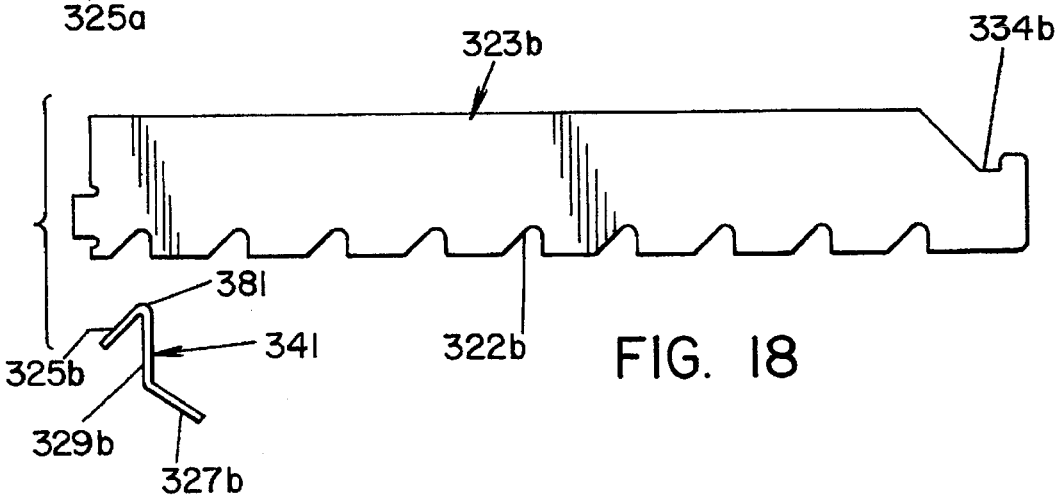
FIG. 18

FIG. 15
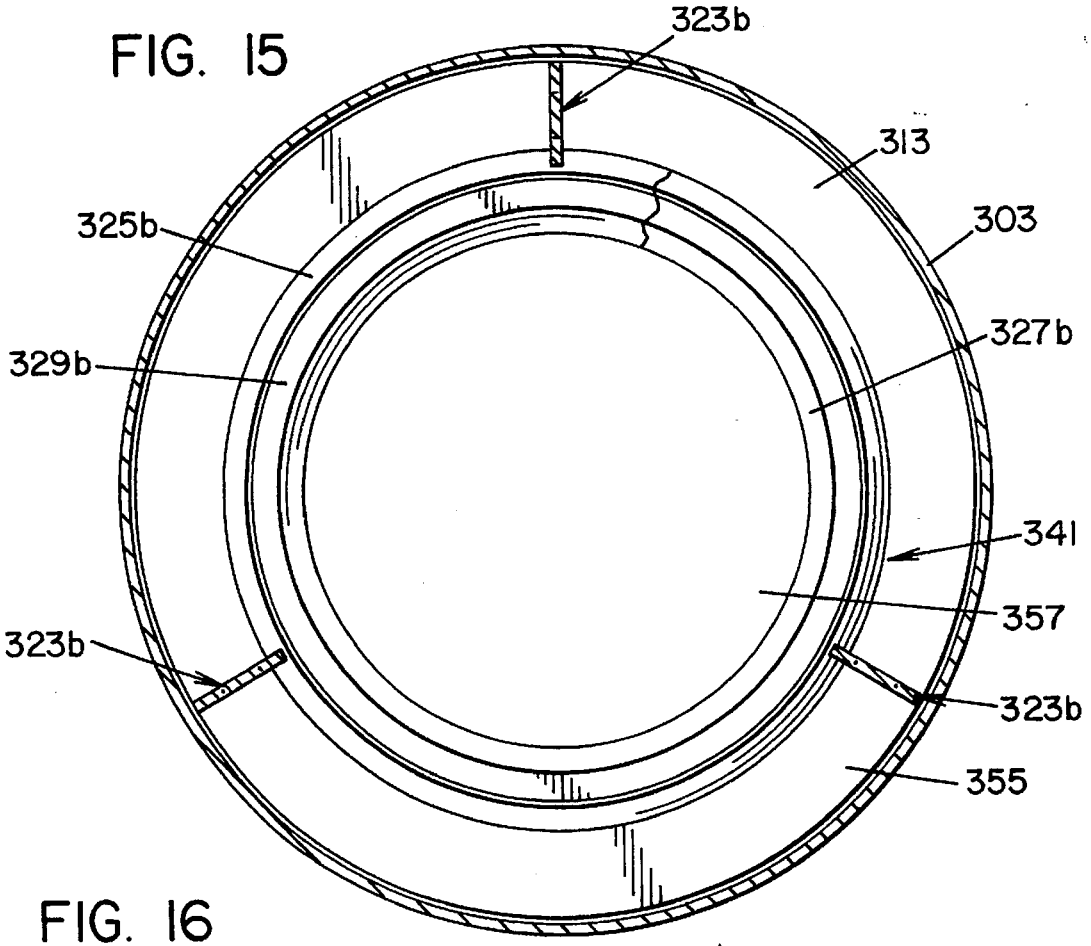
FIG. 16
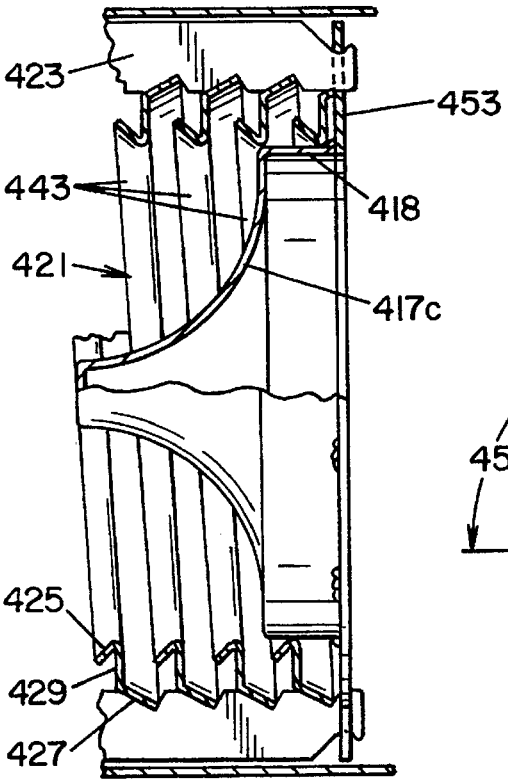
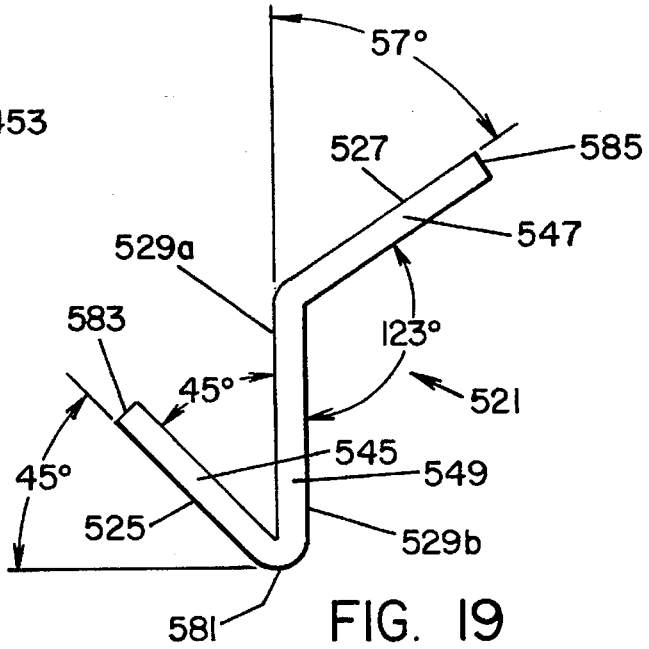
FIG. 19

SOUND ATTENUATING DEVICE AND INSERT

CROSS REFERENCE TO RELATED APPLICATIONS

This is a continuation-in-part of application Ser. No. 08/114,156, filed on Sep. 1, 1993, now U.S. Pat. No. 5,413,189.

BACKGROUND OF INVENTION

This invention relates to mufflers of the sound-modifying type used with internal combustion engines to attenuate engine noise. More specifically, the invention relates to the construction of a muffler containing an insert having one or more means for directing the flow of exhaust gases and a plurality of reflecting surfaces for internal attenuation of sound waves.

Engine noise in an internal combustion engine typically is generated by the sudden expansion of combustion chamber exhaust gases. As the combustion gases are exhausted from each cylinder of the engine, a sound wave front travels at rapid sonic velocities through the exhaust system. This wave front is the boundary between the high pressure exhaust pulse and ambient pressure. When the sound wave front exits the exhaust system, it continues to pass through the air until three dimensional diffusion causes it to eventually dissipate. As the wave front passes an object, an overpressure is created at the surface of the object, and it is this overpressure that is the direct cause of audible and objectionable noise.

Since the inception of the internal combustion engine, efforts have been underway to reduce or muffle the noise caused by the engine. Obviously, considerable noise attenuation or reduction can be achieved in a muffler having dimensions that are large enough to permit three dimensional dissipation of the sound waves within the muffler housing. However, from a practical standpoint, design criteria often dictate that the size of the muffler must be kept as small as possible. Further means of attenuating engine noise include the use of packings and complex baffle systems. Often, these approaches are accompanied by a substantial increase in the back pressure or resistance of the muffler to the free discharge of the combustion gases. The increase in back pressure can result in a decrease in the output horsepower of the engine with a resulting loss of efficiency and fuel economy. Thus, it is clear that a goal of most muffler designs is to achieve maximum attenuation of sound within a muffler system of reasonable proportions while reducing or minimizing back pressure.

Increasingly, the public awareness and objection to environmental problems including "noise pollution" has led to more stringent noise control regulations. At the same time, there is a strong mandate for greater fuel economy and more complete fuel combustion along with smoother and more efficient operation of internal combustion engines. Achieving these seemingly incompatible objectives in a muffler design is a constant challenge.

BRIEF DESCRIPTION OF THE INVENTION

This invention relates to mufflers of a type commonly used to attenuate or reduce the sounds generated by internal combustion engines. More specifically, the invention relates to a muffler having a compact design and containing one or more inserts, each insert comprising a sound reflector core for providing sound attenuation with minimum back pressure. The muffler can be used with any type of engine but is especially adapted for use with inboard or sterndrive marine engines.

The muffler of this invention, also referred to as a sound attenuating device, includes an inner chamber, and an annular outer chamber surrounding the inner chamber and radially spaced therefrom. The two chambers are contained within an axially extending housing having an inlet means and outlet means for the passage of the gases of combustion. The housing is cylindrical and may be round or oval in cross-section.

The combustion gases flow from the engine through an exhaust pipe to the muffler where they enter the inner chamber through the muffler inlet means. The gases are than redirected by means comprising one or more directors axially spaced from one another within the inner chamber. The gas flow is redirected from a first direction into one or more flow paths generally orthogonal to said first direction whereby said gases pass through at least one open passageway from the inner chamber into the outer chamber. As the gases flow into the outer chamber, the attendant sound waves are bounced off the reflector means comprising at least one planar reflective surface extending into the open passageway at an angle whereby sound waves are reflected from the planar surface back into the inner chamber to cause attenuation of the sound.

In one embodiment, the reflector means comprises a plurality of discrete annular, preferably metal, acoustical reflector rings axially spaced from one another to provide a plurality of open passageways between the inner chamber and the outer chamber. These annular reflector rings generally define the shape of the insert and are maintained in fixed, spaced-apart relationship to one another by suitable means such as spacers to determine the overall dimensions of the inner chamber. Each reflector includes at least one and preferably two or more reflective surfaces to repeatedly reflect and attenuate the sound waves as they pass through to the outer chamber. It has been found that the use of a first reflective surface, which forms an angle of 45° or less with respect to the muffler axis when used with a second reflective surface forming an opposite angle of approximately 32° with respect to the said axis, results in a high degree of sound attenuation.

As the exhaust gases and attendant sound waves enter the muffler and progress along the axis of the muffler, a portion of the gases and the sound waves are redirected by each of a plurality of directors spaced axially from one another within the inner chamber. The directors include a generally frusto-conical flow diverter at the downstream end of the inner chamber with the conical portion extending into the chamber toward the inlet. Upstream from this frusto-conical diverter are one or more annular flow directors extending radially in from the annular reflector rings, each one adapted to redirect a portion of the exhaust gases radially outwardly to pass from the inner chamber into the outer chamber. This results in the creation of smaller, finite wave fronts moving generally at right angles to the original wave front moving in the first direction. The smaller wave fronts progress in the radial direction out of the inner chamber into the outer chamber. This causes some three-dimensional diffusion of the sound wave to occur, resulting in a decrease in the overpressure within each of the smaller wave fronts. As previously mentioned, the sound wave is reflected from either of two surfaces which form, respectively, an angle of 0 to 45° and about 32° with respect to the muffler axis. The portion of the wave front that is reflected from the first surface continues through a series of reflections back toward the center of the muffler in the inner chamber. The portion of the wave front that bypasses the first surface is reflected from the second surface positioned radially outward of said first surface and continues through a series of reflections, with substantially all of the waves returning into the inner chamber. This unique method of redirecting the wave fronts back toward the axis of the muffler while diffusing the gases radially outwardly results in significant sound attenuation while minimizing back pressure buildup.

In another embodiment of the invention, the sound reflector means comprises a generally helically-shaped reflector core. Each successive loop of the helix is axially spaced from the immediately preceding loop to form a continuous passageway between adjacent convolutions for the flow of exhaust gases from the inner chamber into the outer chamber. The helix includes at least one sound reflector surface extending into the outer chamber for reflecting the sound waves in a direction with respect to the flow of the exhaust gases to cause attenuation of the sound waves.

Additional sound attenuation is achieved in another embodiment of the present invention by providing the muffler with at least one additional sound reflector core downstream from the first reflector core. In this embodiment, the muffler comprises an inner chamber as previously described including the flow diverters for directing the flow of gases into the annular outer chamber surrounding the first chamber. As before, the gases pass through a continuous annular passageway means formed by a plurality of spaced apart convolutions of a helical reflector core. Alternatively, they may pass between a plurality of separate annular reflector rings spaced from one another to form a plurality of discrete passageways. The first reflector core includes at least one and preferably at least two acoustical reflector surfaces to reflect sound waves back into the inner chamber. The annular outer chamber of the muffler extends axially beyond the downstream end of the inner chamber, and surrounds an exit flow tube. As the exhaust gases move rearwardly in the outer chamber, they pass from the outer chamber radially inwardly through a second reflector core into the exit flow tube, typically attached to an exhaust pipe, and thence to the atmosphere. A solid partition preferably separates the first core from the second core to ensure that there is no direct communication of sound waves between the inner chamber and the exit tube. The second reflector core includes at least one planar sound reflector surface extending into the annular outer chamber at an angle to the direction of flow of the gases whereby sound waves are caused to be reflected radially back into said outer chamber. Additionally, second and third planar reflector surfaces may be used to provide additional reflection of the sound wave front, thereby providing for additional attenuation.

In still another embodiment of the invention, a sound reflector for use in a muffler is formed from an elongated metallic strip having first and second parallel surfaces, and first and second edges. The strip is shaped into first, second and third segments to create a plurality of sound reflection surfaces. The first and second segments are joined to one another at an acute angle to form a longitudinally extending apex. The acute angle formed by the first surface preferably is about 45°. The second segment is joined to the third segment to form an obtuse interior angle along the second surface of the strip. The angle preferably is between about 115° and 130°, and more preferably about 123°. The third segment terminates along the second edge of the strip.

The metal strip from which the reflector is formed has a thickness to width ratio between about 1:10 and about 1:30, preferably about 1:20. The thickness of the strip is between about 20 and about 50 mils, preferably about 35 mils. The reflector is in the shape of a coil with the parallel surfaces of the second segment forming an angle of about 90° with respect to the axis of the coil. In one version, the strip is coiled around the apex as the inner diameter and in a second version, the strip is coiled so that the second edge forms the inner diameter and the apex forms the outer diameter. In either version, the coil may be in the shape of an integral ring or a helix.

The sound reflector may be fabricated from a flat elongated strip of metal, preferably by roll forming the strip into multiple segments. The strip preferably is formed into three generally planar segments. The first and second segments form an acute angle with respect to one another along the first parallel surface of the strip. The two segments meet to form an apex therebetween. The second and third segments are joined together to form an obtuse angle therebetween. This angle is formed along the second parallel surface of the formed strip.

The shaped strip is then coiled into a ring or into a helix depending upon design preference. The strip may be coiled one way about the apex as the inner diameter to form a plurality of rings or a continuous helix for use as a reflector core in a one stage muffler or in the first stage of a two stage muffler. Alternatively, the shaped strip may be coiled the opposite way with the apex forming the outer diameter to create discrete rings or a helix for use in the second stage of a two stage muffler.

DESCRIPTION OF THE DRAWINGS

FIGS. 5A and 5B show, respectively, an exploded view and an assembled view, both in cross-section of two adjacent reflector ring assemblies and one gas flow deflector;

FIGS. 6A and 6B show, respectively, in an exploded view and an assembled view, a reflector ring assembly;

FIG. 13 is a perspective view, partially in cross-section and partially disassembled, of the helical sound reflector and spacers used in the muffler design of FIG. 10;

FIG. 15 is a cross-sectional view taken along lines 15—15 of FIG. 14;

FIG. 16 is a partial cross-section view of a modified design of the gas deflector and partition between the first and second stages of the muffler shown in FIG. 14;

FIG. 17 is an enlarged profile view of a spacer and one loop of a first stage helix of the muffler shown in FIG. 14;

FIG. 18 is an enlarged profile view of a spacer and one loop of the second stage helix of the muffler shown in FIG. 14;

FIG. 19 is an enlarged view of a formed metal used to make the sound reflectors.

DETAILED DESCRIPTION OF THE INVENTION

This invention relates to a muffler of the type commonly used to reduce the sound generated by the operation of an internal combustion engine. The type and nature of the engine generally is not a factor in the teachings of the invention. For example, the muffler could be used with in-line, V6, V8, rotary as well as single-cylinder internal combustion gasoline and diesel engines. All such engines would and could benefit from the use of the muffler of the present invention.

More specifically, the invention relates to a muffler which includes an insert comprising a plurality of annular sound reflector rings and one or more gas flow directors. The insert divides the muffler into an inner chamber and an outer chamber. The component parts of said insert are capable of being assembled together in a simple manner to form a plurality of passageways through which combustion gases are caused to flow from the inner chamber into an outer chamber radially surrounding the inner chamber. The sound waves accompanying the gases are reduced in intensity as they are reflected off of the surfaces of the sound reflector rings back into the inner chamber. The angles at which the reflection surfaces are placed relative to the direction of flow of the gases and sound waves result in a high degree of sound attenuation by intercepting the sound waves and redirecting them back into the center of the inner chamber.

Figure 1:
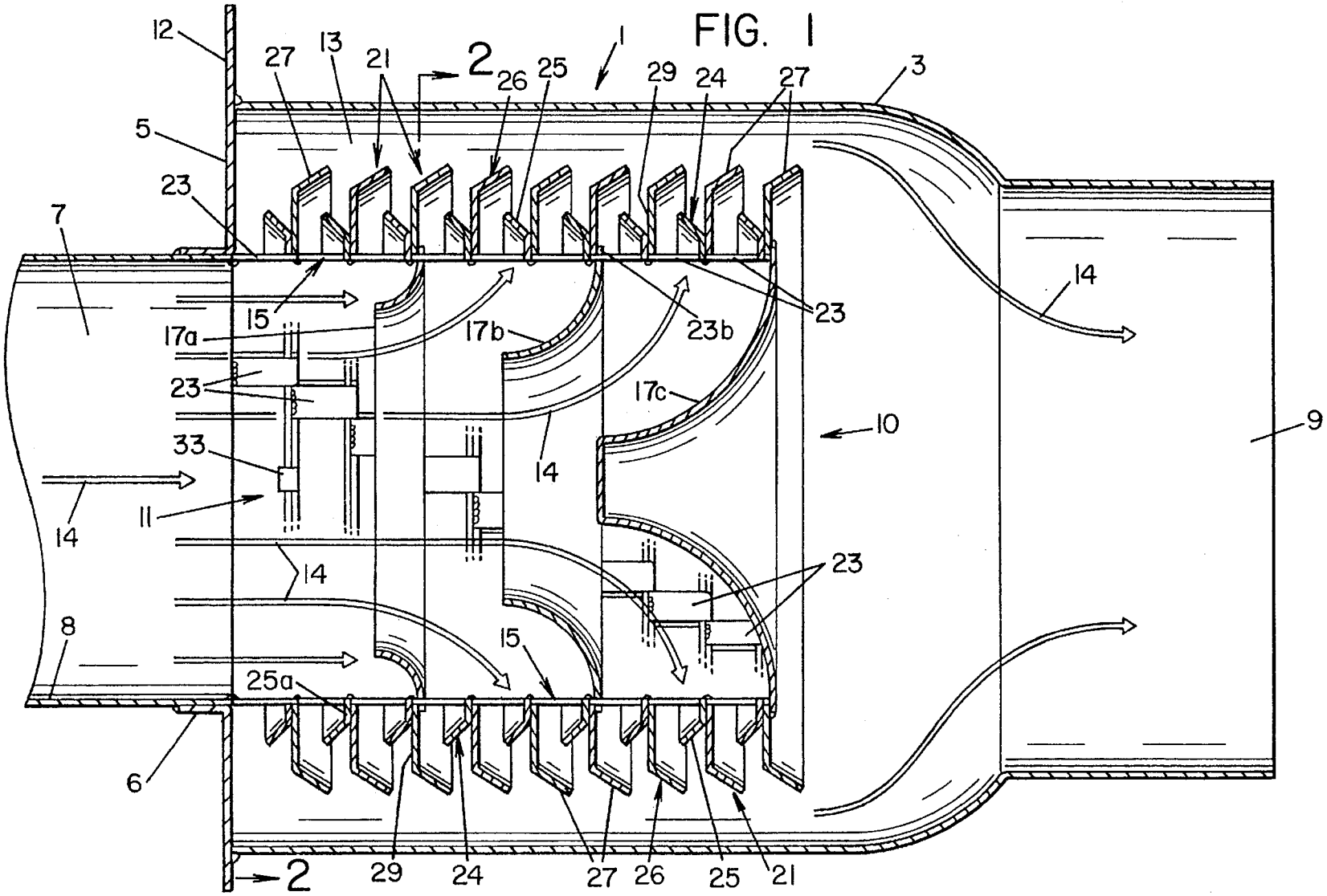
FIG. 1 is a cross sectional view of the muffler of the present invention.
Figure 2:
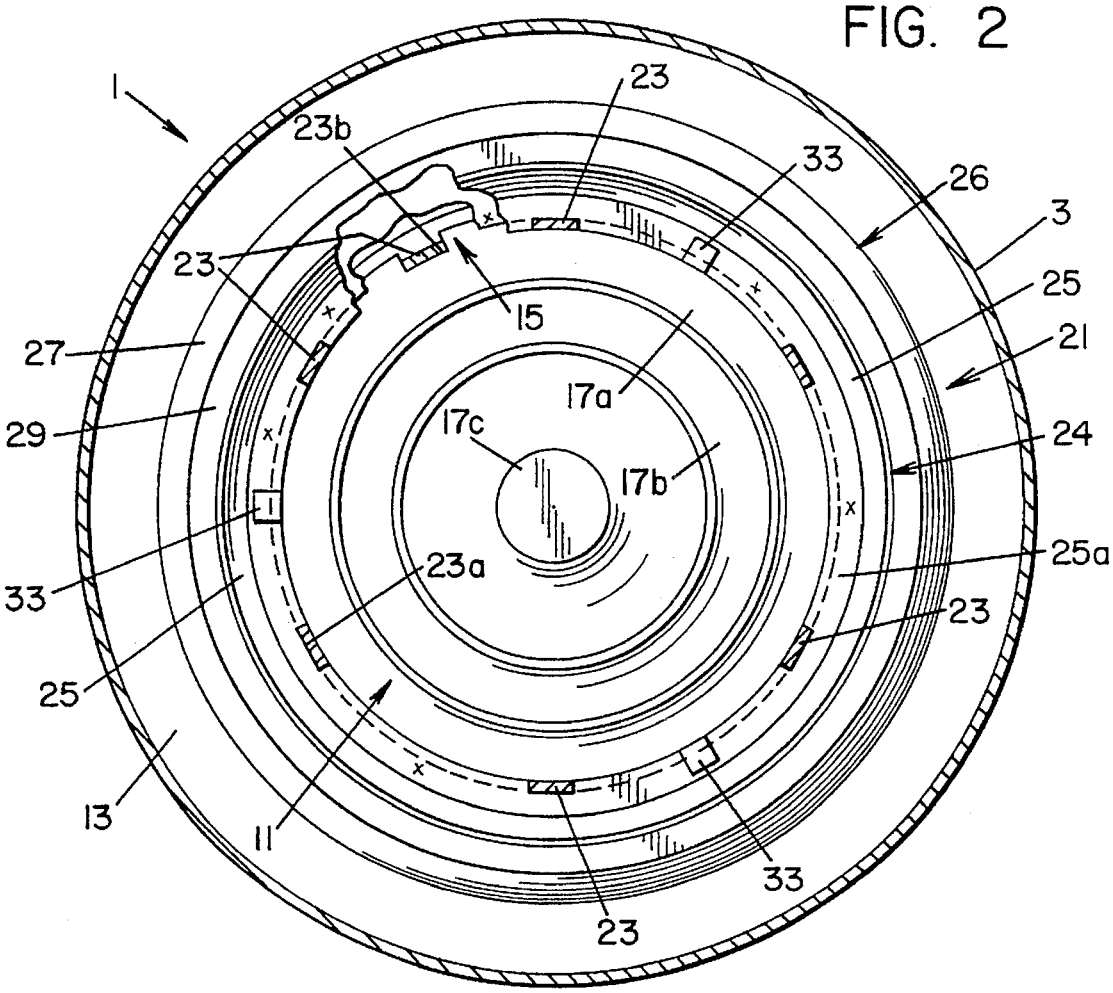
FIG. 2 is a cross sectional view taken along lines 2—2 of FIG. 1.

Referring now to the drawings, FIG. 1 shows a muffler 1 contained within a muffler housing 3. The inlet 7 of the muffler of the present invention is defined by an annular end wall 5 and a flange 6. The flange is adapted to be welded or clamped to an exhaust pipe 8, the exhaust pipe in turn communicating directly with the exhaust manifold of an internal combustion engine. When used on a marine vessel, the end wall may extend radially outwardly to form a second flange 12 adapted to be fastened to the stern of the vessel. At the opposite end of the muffler is an outlet 9 which is adapted to be coupled to a functional or decorative tail pipe (not shown). Depending on the position, use and space requirement and restrictions, the exhaust system may or may not use a tail pipe.

The muffler contains an insert 10 which defines an inner chamber 11 and an outer chamber 13. The insert contains a plurality of openings 15 which allow hot exhaust gases to pass from the inner chamber to the outer chamber and thence to the atmosphere. The inner chamber contains one or more gas flow diverters shown as directors 17*a*, 17*b* and 17*c*. The flow of exhaust gases through the muffler is shown by the arrows 14 in FIG. 1. The directors are used to redirect the gas flow and the sound waves from a first direction into a second radial direction. The directors are positioned and sized so as to distribute the flow of exhaust gases somewhat equally along the axial length of the inner chamber through the flow path openings 15 between the spaced reflector ring assemblies 21. Director 17*a* closest to the inlet is the smallest of the annular directors and is generally in the shape of a curved flange or washer attached to a selected reflector ring. Because the volume of gas flowing in an axial direction is decreased after passing the first director ring, the second annular director 17*b* is larger and has a smaller annular opening than the first director. It likewise redirects a portion of the remaining axially flowing gases into the openings 15 between the reflector rings 21 located between the two directors 17*a* and 17*b*. The remainder of the gases are then redirected by the frusto-conical director 17*c* which closes off the exit end of the inner chamber. As mentioned, the annular directors 17*a* and 17*b* are sized so as to redirect a proportionate volume of gases through the openings 15 of the insert 10 into the outer chamber and are generally concave in cross-section to minimize turbulence as the gas flow is redirected from the axial to the radial direction. The inner chamber is separated from the outer chamber by the insert 10 comprising a series of reflector ring assemblies 21. Each ring assembly is spaced apart from the next adjacent ring assembly by means such as spacers 23. Depending upon the degree of structural rigidity or the size of the muffler and the materials of construction, between 3 and 12 spacers are used to attach each ring to the next adjacent ring. Preferably, the spacers connecting two ring assemblies together are offset circumferentially from the spacers joining the next adjacent ring assembly so as to facilitate the even flow of exhaust gases past the reflector surfaces.

Figure 4:
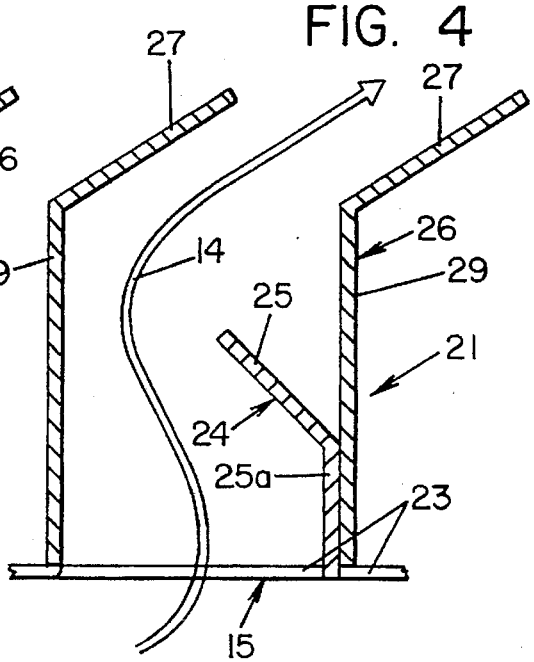
FIG. 4 is a diagram showing the path of the exhaust gases flowing past the acoustical reflectors.

Each ring assembly 21 is comprised of a first reflector element 24 and a second reflector element 26. The first reflector element 24 comprises a reflective surface 25 and a support leg 25*a*. Two sets of notches 23*a* and 33*a* are provided on the inner edge of the support leg 25*a* to engage corresponding spacers 23 and lugs 33 on the second reflector element 26. The reflective surface 25 forms an angle of about 45° or less with respect to the muffler axis. In a preferred embodiment, this first reflective surface extends radially outwardly at an angle of at least 135° with respect to the direction of flow of the gases entering the inner chamber 11. This causes the radially moving gases to be diverted around the reflector surface as shown in FIG. 4.

This first reflector surface extends into the annular space between adjacent ring assemblies a sufficient distance to cause a substantial portion of the sound waves to bounce and be internally reflected, as will be hereinafter described more specifically with reference to FIG. 3. Generally, the first reflective surface 25 should extend between about 20% and 80%, preferably between about 40% and 60%, of the distance between the adjacent rings.

The second reflector element 26 comprises a reflector surface 27 radially outside of, and inclined in the opposite direction to, reflector surface 25. This causes the exhaust gases to be redirected to flow toward the muffler outlet 9 as they pass into the outer chamber (See FIG. 4) while simultaneously causing the sound waves which had bypassed the first reflector surface 25 to be internally reflected away from the outlet. The angle that the second reflector surface 27 forms with respect to the muffler axis and to the axial direction of flow is preferably between about 25° and 40° and more preferably about 33°. This second surface extends into the opening 15 a sufficient distance so that substantially all of the sound waves which bypass the first surface 25 will strike and be reflected off said second surface.

The second reflector element 26 includes a third reflector surface 29 which is integrally joined to reflector surface 27. This third reflector surface is preferably, but not necessarily, at right angles to the axis of the muffler.

Figure 3:
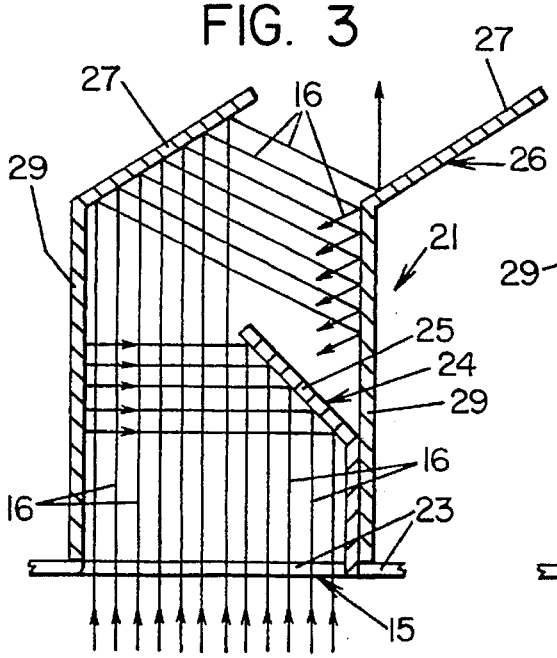
FIG. 3 is a diagram depicting the movement of sound waves as they are reflected off of the surface of the acoustical reflectors shown in FIG. 1.

The effect of the reflector surfaces on the sound waves is shown in FIG. 3. These sound waves are represented by a series of parallel lines and arrows 16. The waves, after having been deflected by the gas flow directors in the inner chamber, move radially in straight lines through the openings 15 between adjacent rings 21. A portion of the waves contacts the first reflector 25 which, as previously stated, is at an angle of preferably about 45° with respect to the muffler axis extending in the direction opposite to the axial flow of the gases. These waves are reflected off the first reflector 25 in a generally axial direction where they contact the reflector surface 29, which is positioned generally perpendicular to the muffler axis at right angles to the direction of the sound waves coming from reflector 25. This causes the sound waves to be reflected back to the first reflector surface 25 from where they are reflected back into the interior of the inner chamber. Each deflection of the sound waves causes attenuation or weakening of the waves. A portion of the sound waves bypass the first reflector surface 25 and continue radially outward until they contact the second reflector 27. These sound waves are bounced off of the second surface toward the third reflector surface 29, where further reflections against surfaces 25, 27 and 29 cause these sound waves to eventually reflect back into the inner chamber where further attenuation occurs. As the sound is being attenuated, the hot exhaust gases flow freely past the reflector 25 and are redirected by the second reflector 27 toward the rear of the muffler where they exit through the outlet to the atmosphere.

Figures 7, 8:
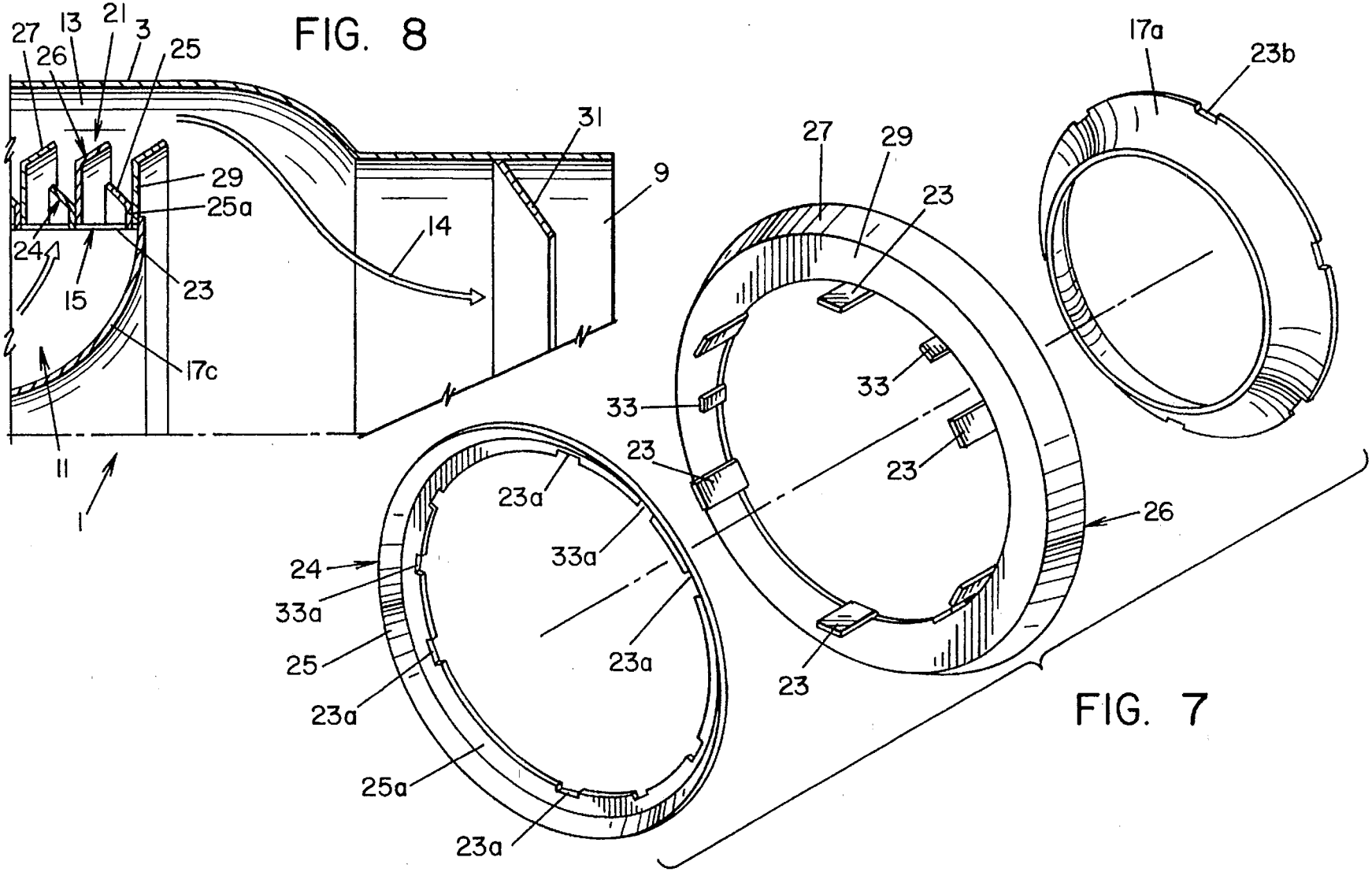
FIG. 7 is an exploded perspective view of the component parts of a hot gas deflector and a reflector ring assembly.
FIG. 8 shows a modification of the present invention with an additional acoustical reflector positioned in the muffler outlet.

FIGS. 5, 6 and 7 show in a general manner a preferred method of assembling the reflector rings and gas flow directors into the insert 10. FIG. 5A shows in expanded view the component parts of a reflector ring assembly including first reflector element 24 comprising reflector surface 25 and supporting leg 25*a*, and the second reflector element 26 comprising the second and third reflectors 27 and 29. The second element 26 contains spacers 23 and locking lugs 33 (shown in FIGS. 6 and 7) positioned around its inner periphery. The spacers 23 are adapted to engage notches 23*a* in the support leg 25*a* of the first reflector and notches 23*b* in the gas director 17*a*. As shown in FIG. 7, each assembly contains 6 spacers adapted to mate with corresponding notches in the support leg 25*a* and the director 17*a*.

As shown in FIGS. 6A and 6B, three or more locking lugs 33 on reflector element 26 are adapted to mate with the notches 33*a* in the support leg 25*a* of reflector element 24. The locking lugs are then crimped against the reflector 25 to hold the reflector ring assembly 21 together as shown in FIG. 6*b*. Again referring to FIG. 5, a plurality of individual ring assemblies are joined together in spaced apart relationship by spot welding each ring assembly to the ends of the spacers 23 of the next adjacent assembly, said spacers engaged in the respective notches 23*a*. The annular flow director 17*a* can likewise be assembled together with a specific reflector ring, in like manner with the notches 23*b* in the director adapted to mate with corresponding spacers 23. Alternatively, the directors can be joined to the respective reflector rings by other means such as spot welding or brazing.

FIG. 8 shows a further embodiment of the invention in which a sound reflector ring 31 is placed in the outlet 9 of the muffler to further reflect and attenuate sound waves which may have bypassed the reflector surfaces 25, 27 and 29 formed by the individual reflector rings 21. This optional reflector ring must not substantially impede the exhausting combustion gases. Therefore, it would normally not extend radially into the muffler outlet more than approximately 25% of the diameter of the outlet.

Figure 9:
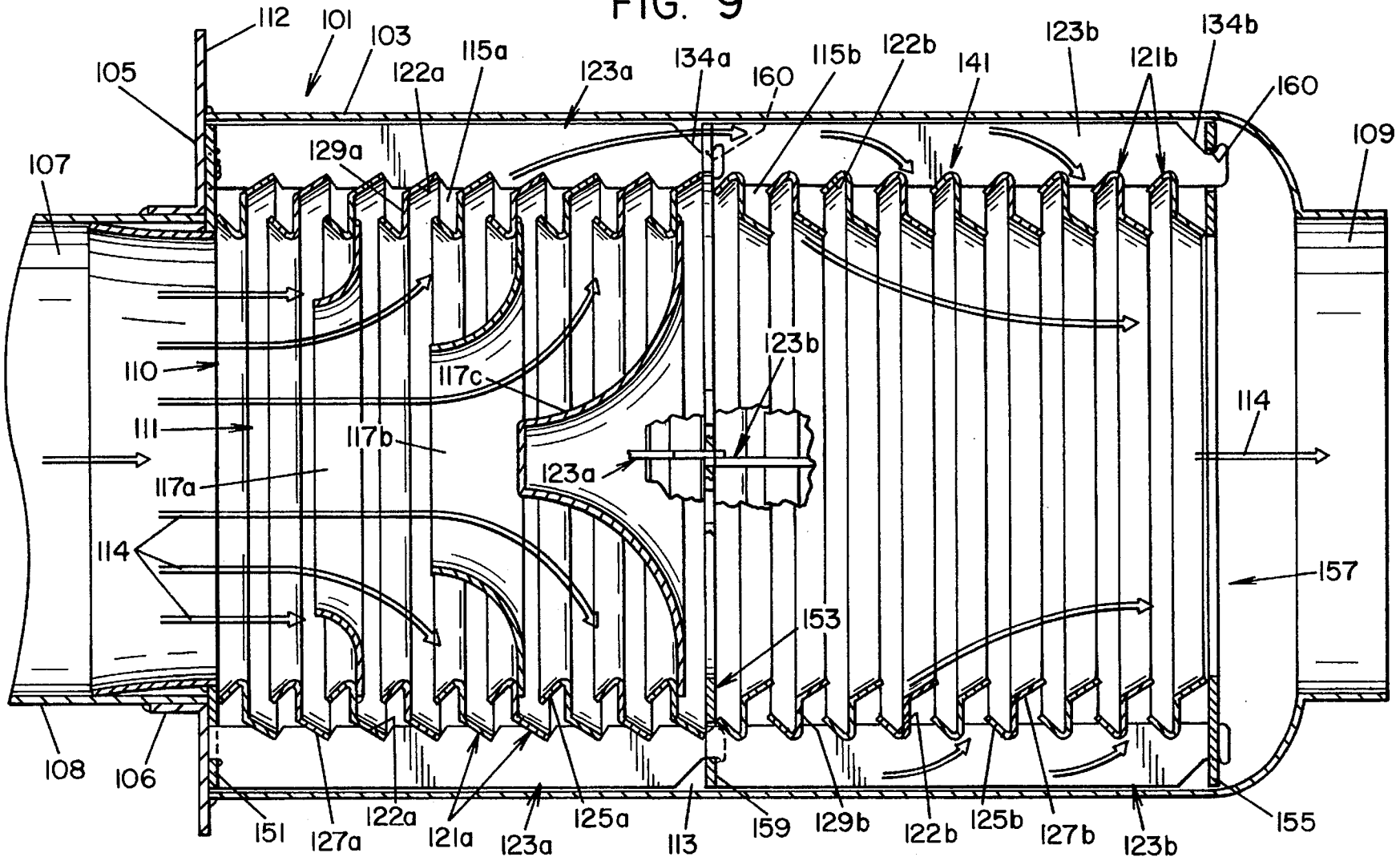
FIG. 9 is a cross-sectional view of a muffler showing a two stage design utilizing a pair of discrete reflector cores.

FIG. 9 shows a two-stage muffler 101, the first stage of which is similar to the embodiment shown in FIG. 1. The muffler 101 is contained within muffler housing 103. The inlet 107 of the muffler is defined by an annular end wall 105 and end flange 106. The flange is adapted to be welded or clamped to exhaust pipe 108, which in turn communicates directly with the exhaust manifold of an internal combustion engine. The second flange 112 permits the muffler to be bolted to the stern of a boat. Downstream from the inlet is the outlet 109 where exhaust gases are discharged to the atmosphere.

The muffler contains a first reflector core 110 and a second reflector core 141 preferably but not necessarily, in axial alignment with one another. Each of the cores is positioned within the muffler using a notched spacer 123*a*, 123*b* around the periphery thereof, separating the cores from the housing 103. Details of the spacers used for the first reflector core are shown more clearly in FIGS. 13 and 17. The spacers 123*b* used with the second core 141 are similar in cross-section to the first core spacers 123*a* with the exception that the saw tooth notches 122*a* of spacers 123*a* are replaced with slightly rounded notches 122*b*, the differences being more clearly shown in FIGS. 17 and 18.

The direction of gas flow is shown by arrows 114. As the exhaust gases enter the muffler in a generally axial direction, these gases contact one of the flow directors 117*a*, 117*b* or 117*c*. As before, these flow directors serve to redirect the gas flow from an axial to a radially outwardly direction where the gases pass from the inner chamber 111 through passages 115*a* into the outer chamber 113. At the same time, the sound waves are attenuated in the manner previously described. As the gases enter the outer chamber, they are redirected by the muffler housing in an axial direction rearwardly toward the muffler outlet 109. Before reaching the outlet, they pass through the spaces 115*b* between reflector rings 121*b*, into the exit chamber 157 and then through muffler outlet 109 to the atmosphere.

Concurrently, the sound waves which are not fully attenuated when passing through the first reflector core 110 contact one or more of the planar surfaces of the rings 121*b* comprising the second reflector core 141, causing the sound waves to be reflected back into the outer chamber 113. The reflection of the wave front occurs in a manner very similar to that shown in FIG. 3, with the exception that the sound waves are being reflected back into the outer chamber and thus are impeded from entering the exit chamber 157.

The spacers 123*a*, positioned around the periphery of the first reflector core 110, are held in fixed position within the muffler housing 103 by a slotted annular blank 151 welded or otherwise secured to the muffler end wall 105, and a partition 153 separating the first reflector core from the second reflector core. This partition comprises an annular or solid blank having an outer diameter approximately equal to the outer diameter of the first reflector core, and containing three or more slotted lugs 159 projecting radially outwardly from the core into contact with housing 103.

In like manner, three or more spacers 123*b* are held in position around the inside of the muffler housing 103 by the partition 153 and a second annular blank 155. The second blank contains slots 160 into which one end of the spacers 123*b* are positioned. The spacers 123*a* and 123*b* may be axially aligned with one another, in which case, each slot in the partition 153 is made sufficiently wide to accommodate the notched ends of two spacers. Alternatively, one set of spacers can be offset, circumferentially, from the other set of spacers in which case the partition 153 will contain individual slots for each spacer. The partition and the blanks preferably, but not necessarily, are secured to the housing by welding. It is understood, however, that if one of the annular blanks, or the partition, are welded to the housing, there is no necessity to weld the other two into place, inasmuch as their position in an axial direction will be fixed by the notches 134*a*, 134*b* in spacers 123*a*, 123*b* engaging the slots 160.

Figure 12:
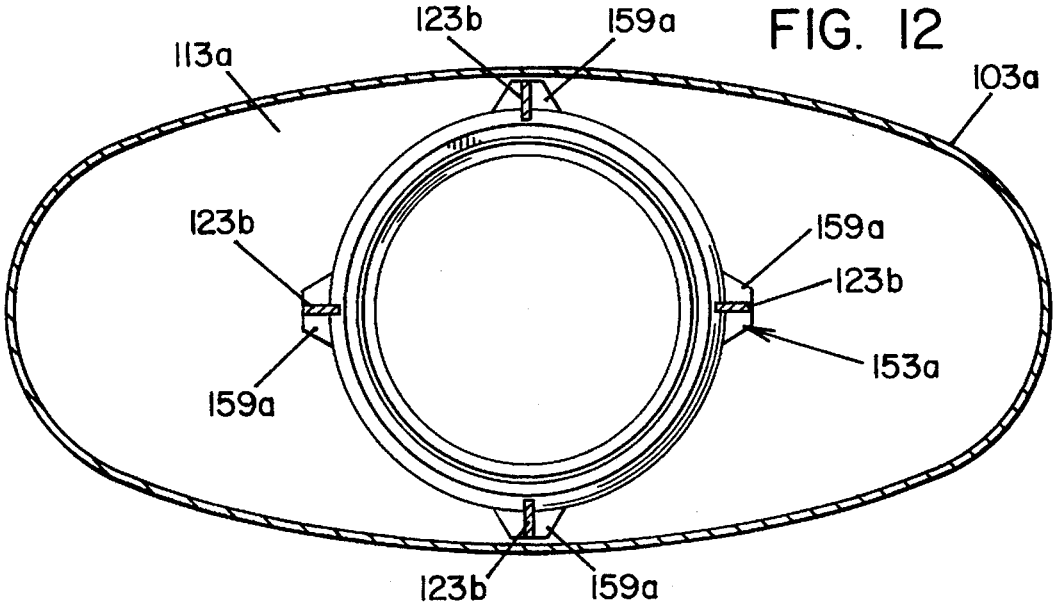
FIG. 12 is a cross-sectional view of a two stage muffler shown in the shape of an oval.

Although the two stage muffler shown in FIG. 9 is generally circular in cross-section, a modification of this shape is shown in FIG. 12. In certain applications, particularly automotive, an oval rather than circular housing 103*a* may be advantageously employed. This provides shape more space in the outer chamber 113*a* for enhanced attenuation of the sound waves as the exhaust gases pass through the second reflector core (not shown). The reflector cores are generally circular in cross-section but can also be oval without sacrificing sound attenuation. Each of the reflector cores is held in place by a partition 153*a* and annular blanks, preferably using 4 lugs 159*a* with slots to accommodate spacers 123*b*. The reflector cores may be cantilevered from the front wall of the muffler, and added support for the cores may be provided by welding or otherwise securing two or more of the partitions and the lugs of the annular blanks to the oval housing.

Figure 10:
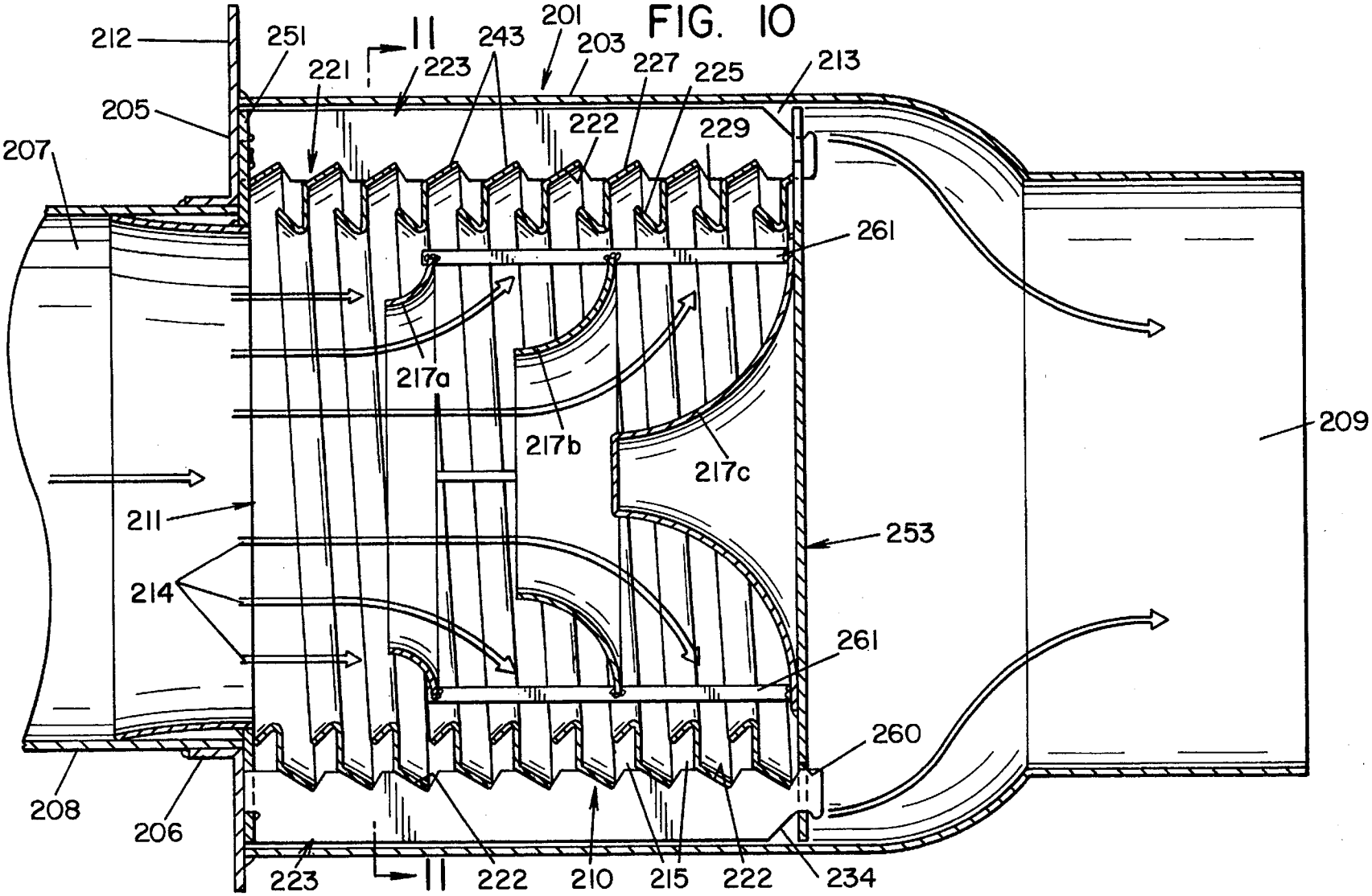
FIG. 10 is a cross-sectional view of a one stage muffler wherein the reflector core is in the shape of a helix.
Figure 11:
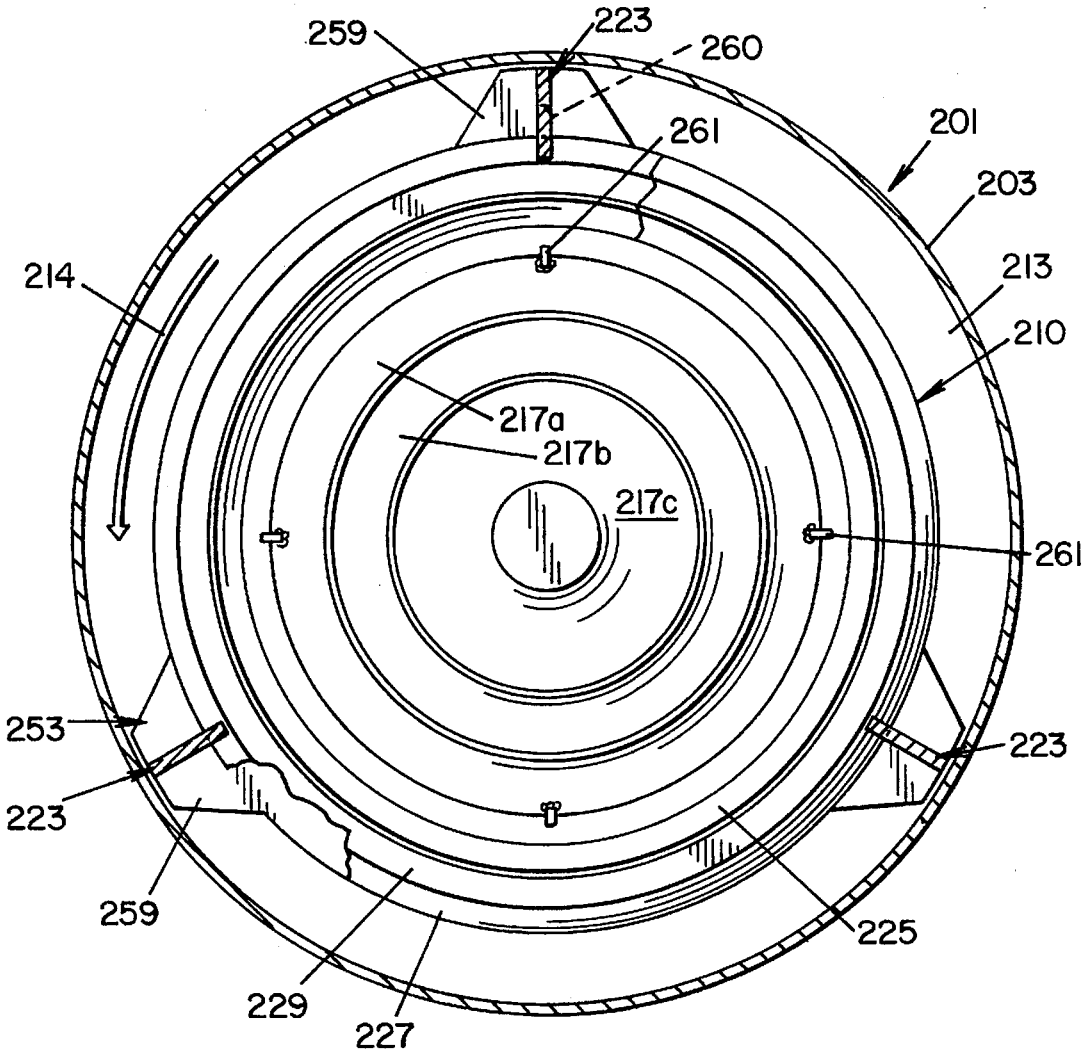
FIG. 11 is a view taken along lines 11—11 of FIG. 10 showing additional details of the helical reflector core.

FIGS. 10 and 11 show a modification of a one-stage muffler 201, wherein the individual reflector rings are replaced with a one piece helix 221 to form a unitary helical reflector core 210. The core comprises a plurality of convolutions 243 spaced from one another to permit exhaust gases to flow from exhaust pipe 208 through inlet 207 in the direction shown by the arrows 214. The cross-sectional shape of the reflection surfaces 225, 227 and 229 as well as the respective angles are the same as those shown in FIG. 1, as previously described and the sound attenuating properties are similar.

Three flow diverters or baffles 217*a*, 217*b* and 217*c* are positioned within the reflector core 210 and are held in place by metal strips or braces 261 to which the flow diverters are welded or otherwise secured. A plurality of spacers 223, with notches 222 along one surface to receive the individual convolutions 243 of the reflector core, are anchored to an annular blank 251 at end wall 205 of the muffler housing 203 by welding and to slots 260 in the partition 253 placed downstream in the muffler in proximity to the muffler outlet 209. As seen in FIG. 11, the partition 253 contains three lugs or projections 259 extending into contact with the housing 203.

Each of the projections 259 contain a slot 260 engaged by notch 234 in spacer 223. The helix imparts a swirling motion to the gases shown by arrow 214 as the gases are deflected by baffles 217*a*, 217*b* and 217*c* from the inner chamber 211 through passageway 215 into the outer chamber 213.

Additional details of the helix are seen in perspective in FIG. 13 wherein three loops or convolutions 243 of the coil 210 are shown. The coil includes first, second and third planar reflective surfaces 225, 227, 229. Each of the spacers 223 includes a plurality of V-shaped notches 222, evenly spaced along its length, to conform to the second reflector surface 227. The notches of one spacer are displaced axially from those of the next adjacent spacer to match the pitch of the helix corresponding to the space between adjacent convolutions. Thus, if three spacers are positioned 120° apart from one another around the coil, and the space between adjacent convolutions of the helix is ¾", then the notch on one spacer is axially displaced ¼" from the corresponding notch on the other two spacers.

Figure 14:
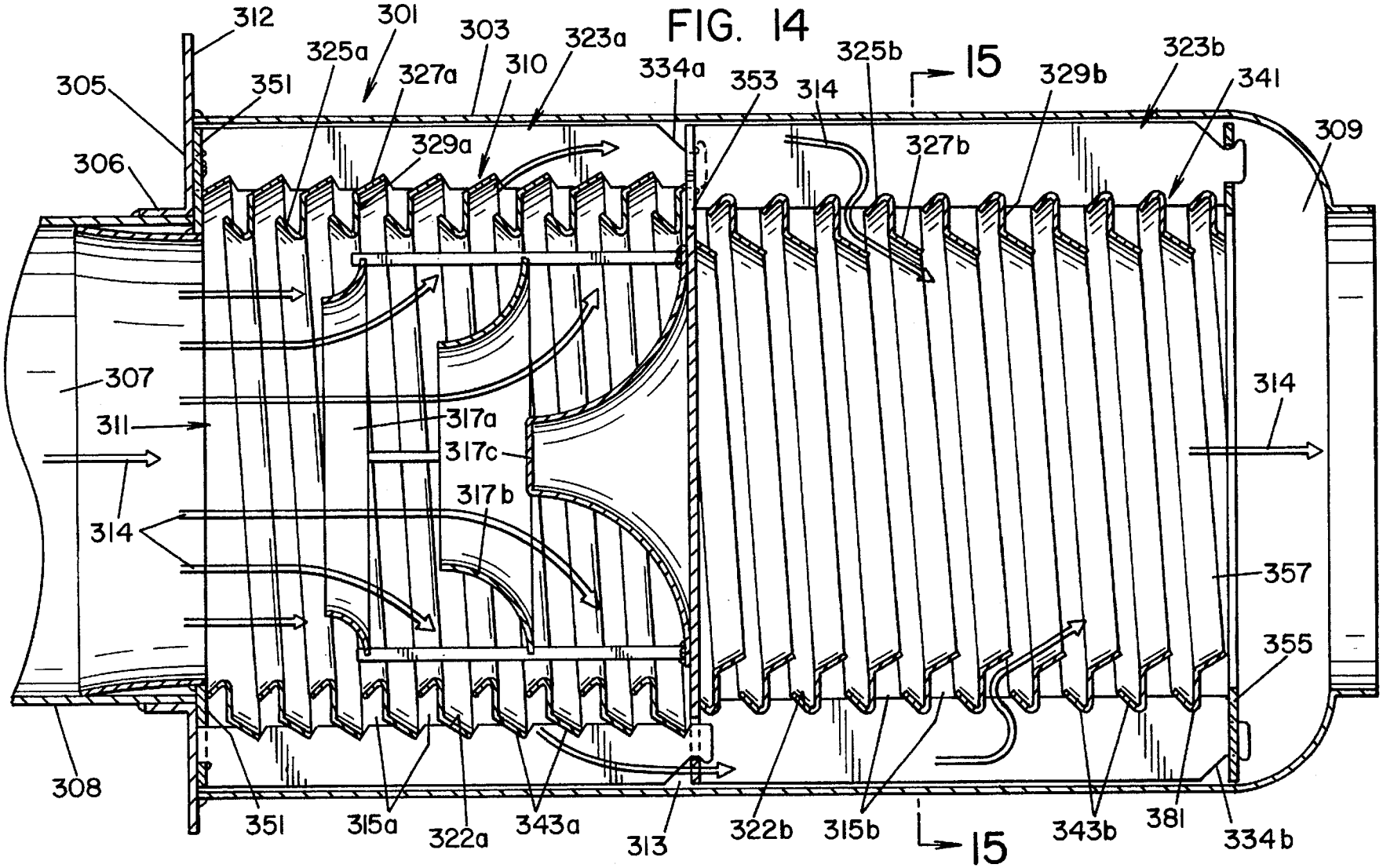
FIG. 14 shows a two-stage muffler using a pair of helical reflector cores.

FIG. 14 shows a muffler having two separate reflector cores, similar in principal to the design shown in FIG. 9. However, in FIG. 14, both of the reflector cores 310 and 341 are formed into the shape of a helix with multiple convolutions 343*a*, 343*b*. This muffler 301 contains a muffler inlet 307, a first reflector core 310, a second reflector core 341 and an exit chamber 357. The muffler comprises a housing 303, an end wall 305 with projecting flange 312 and a mounting flange 306 adapted to be connected to exhaust pipe 308. As before, the flow of gases is shown by arrows 314. Gas flow directors 317*a*, 317*b* and 317*c* serve to divert the axial flow of gases entering the muffler from an axial to a radial direction. The gases pass from the inner chamber 311 through a first passageway 315*a* into the outer chamber 313 where the housing 303 and end wall 305 direct the gas flow in the outer chamber into the annular space surrounding the second reflector core 341. The gases then flow through a second passageway 315*b* past the reflector surfaces forming the second reflector core 341 into the exit chamber 357 and then out through the muffler outlet 309. Additional details of the second stage are shown in FIG. 15.

Notched spacers 323*a*, 323*b* serve to position the first core 310 and the second core 341 within the muffler housing 303. Spacers 323*a* are held between annular blank 351 and partition 353, while spacers 323*b* are held between the partition and the annular outlet blank 355. The cross-section of the first core 310 shows three reflection surfaces 325*a*, 327*b* and 329*a*. In like manner, the second helical core has three reflection surfaces 325*b*, 327*b* and 329*b*.

As previously described, and with particular reference to FIGS. 17 and 18, spacers 323*a*, 323*b* serve to position the cores 310, 341 within the housing 303 of the two-stage muffler shown in FIG. 14. The spacer 323*a*, used to secure the first core 310, contains a plurality of V-shaped notches 322*a* spaced along one edge. The distance between adjacent notches corresponds to the spacing between adjacent convolutions of the core. The notches are shaped to receive surface 327*a* of said core. In like manner, the spacer 323*b* is used to position and secure the second core 341. The notches 322*b* in this second spacer are spaced apart and are contoured to receive the rounded apex 381 of each loop of the second core. The ends of each of the spacers are configured to engage the annular blanks and partitions (not shown). Notches 334*a* and 334*b* facilitate such engagement. Although these spacers are described in association with their use in the two-stage helical design of FIG. 14, they may likewise be used, for any of the single and twin stage mufflers using discrete sound reflection rings and/or helices as herein described.

FIG. 16 is a further modification of the muffler of FIGS. 10 and 14 showing the director or baffle 417*c* closing off the downstream end of the first reflector core. The director 417*c* includes a cylindrical portion 418 which provides a gas seal, when in contact with reflector coil 421. As previously explained, the coil 421 comprises a plurality of convolutions 443 and reflector surfaces 425, 427 and 429 and otherwise functions in the same manner as previously described. However, the use of a reflector core that is square cut prior to coiling, can result in a helix which when installed forms a significant gap when abutted against partition 453. Exhaust gases can pass from the inner chamber through the gap directly into the exit chamber of the muffler with a loss of sound attenuation. The cylindrical shoulder 418 has a width at least equal to the space between adjacent convolutions thereby proving a sufficiently wide surface, to prevent unnecessary leakage of gases. The helix is preferably cut to length after coiling, using a cutting device such as a flying saw, whereby a clean, planar cut at right angles to the helix, is formed. This permits a close fit between the ends of the coil and the notched annular blank or partition respectively, thereby avoiding the creation of a gap.

FIG. 19 is an end view of an elongated strip of metal such as stainless steel which is formed into shape to provide a plurality of segments for use as the reflector cores of the present invention. The shaping may be carried out by conventional processes such as extrusion, roll forming and the like.

More particularly, a one piece sound reflector 521 is shaped into three segments 545, 547, 549 from an elongated flat strip of metal having opposed parallel edges 583 and 585. The first segment 545 provides a first reflective surface 525. The second segment 549 comprises a pair of reflective surfaces 529*a*, 529*b*. It joins the first segment at apex 581 forming an interior angle between the first surface 529*a* and said first segment 525 of about 35° and about 55° and preferably about 45°. The third segment 547 forms an interior angle with the second reflective surface 529*b* of second segment 549 between about 100° and about 150° preferably between about 115° and about 130° and more preferably about 123°.

The metal strip is sufficiently thin to permit it to be shaped by roll forming or other shaping techniques customarily used for this purpose. A thickness between about 20 and about 50 mils, preferably about 35 mils has been found to be acceptable. The ratio of the thickness to width of the strip is generally of the magnitude of between about 1:10 and 1:30, preferably about 1:20.

The shape of the sound reflector 521 permits it to be coiled into a helix or into discrete rings as needed. Furthermore, the reflector 521 may be wrapped around the apex 581 as the inner diameter to form a helix or discrete rings for use as the reflector core in the single stage muffler or in the first stage of the two-stage muffler. On the other hand, the reflector 521 may be coiled in the opposite direction around the second edge 585 as the inner diameter and the apex 581 as the outer diameter of the core, as shown in FIG. 18 to form the second stage helical reflector core or discrete rings. In either case, if the strip is formed into a discrete ring, the two ends thereof are abutted together and may be joined by welding. Whichever way the strip is wound, the second or middle segment 549 preferably is maintained at an angle of approximately 90° with respect to the axis of the ring or coil. The diameter of the coils, as well as the number of reflector cores and the number of rings or convolutions in each core are dependent on a number of factors including engine type and displacement, engine operating speed and space limitations as well as laws and regulations governing noise levels.

It should be noted that the use of external spacers to hold a helical reflector core in place requires that the notches of one spacer be displaced slightly from those of the next adjacent spacer. The amount of displacement corresponds to the pitch of the helix (the space or gap between adjacent convolutions), and the number of spacers used around the periphery of the core. Thus if three spacers are used to secure the reflector core, the notches on one spacer are displaced axially one-third of the distance between adjacent convolutions, from those of the next adjacent spacers. For example, if a space between adjacent convolutions is three-quarters of an inch, and three spacers are used to secure the reflector core in place, notches of one spacer are displaced one-quarter inch from those of the adjacent spacers. When the reflector core comprises discrete rings instead of a helix, the notches of the spacers normally would not be axially displaced from one another.

Figure 20:
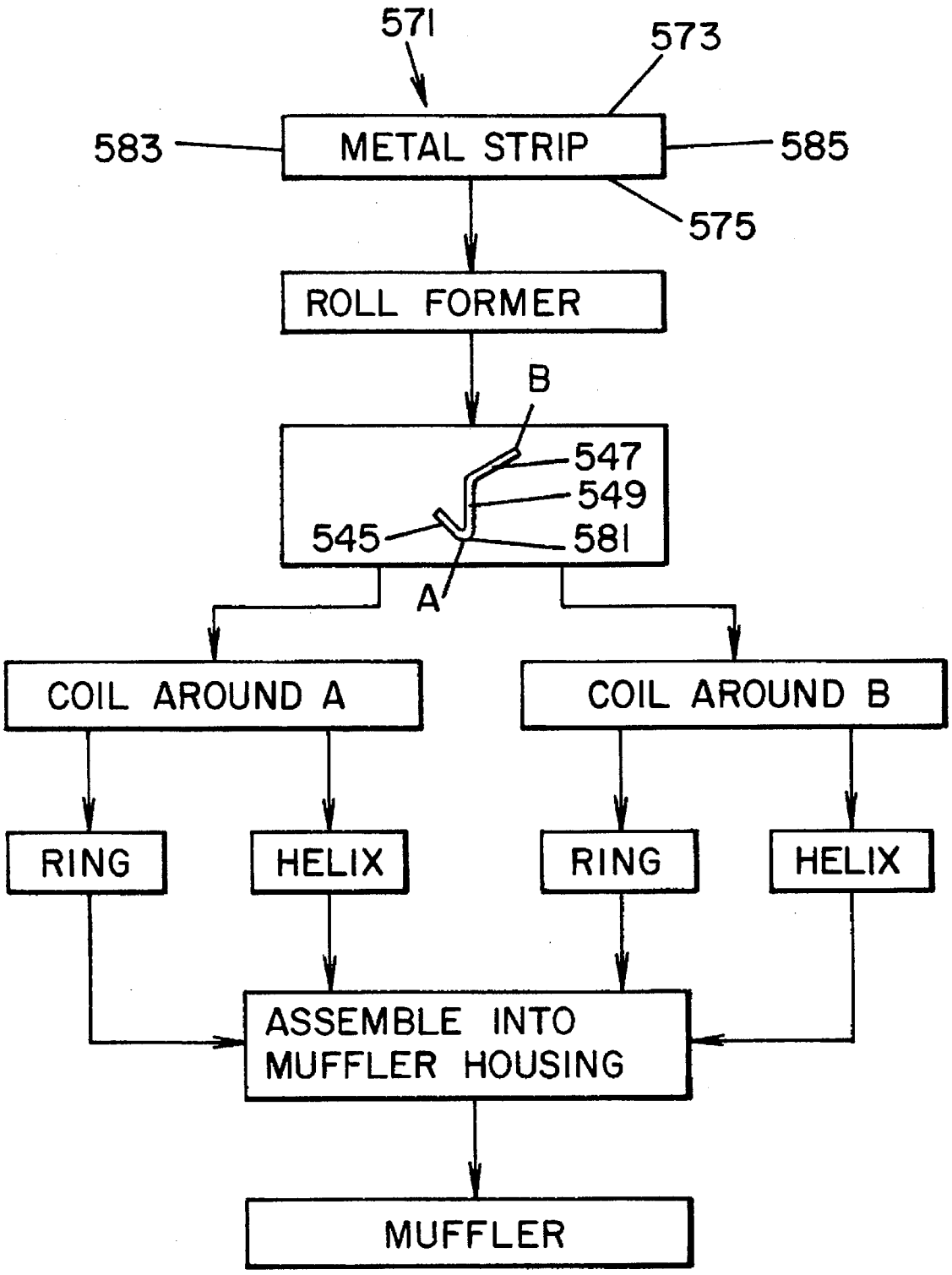
FIG. 20 is a flow diagram showing the strips used in the fabrication of sound reflector of the present invention.

A preferred method of fabricating the sound reflectors useful in the muffler is shown in the block diagram of FIG. 20. To start, an elongated flat metal strip 571 is selected having first planar surface 573 and second planar surface 575 parallel to one another, and edges 583 & 585. The strip typically has a thickness to width ratio between about 1/10 and about 1/30, preferably about 1/20. The metal is selected on the basis of its resistance to the hot exhaust gases and its ability to be formed into shape. The metal has a thickness generally in the range of 20 to 50 mils, and preferably about 35 mils. The flat strip is fed to a shaper such as a roll former where it is worked into the shape of the sound reflector shown in detail in FIG. 19. As shown, the sound reflector comprises three segments 545, 547 and 549. Segments 545 and 549 are joined along apex A. The segment 547 extends in from edge B and joins segment 549 at an obtuse angle thereto.

The shaped sound reflector is then fed to a coiler where it is coiled with apex A, or the edge B forming the internal diameter, depending on use. The reflector is coiled into a single loop to form a ring.

The ends of each ring preferably are joined by welding. Alternatively, the reflector is coiled into a helix. The helix may be formed from an elongated reflector having a finite length, or may be formed from a continuous strip and then cut to length. The coiled reflector is then assembled into a muffler housing to form the completed muffler. External spacers of the type shown in FIGS. 17 and 18 or internal spacers and lugs such as those shown in FIG. 7 are used to maintain the spacing between the discrete rings or convolutions of the helix. External spacers also fix the position of the reflector with respect to the housing.

Other modifications of the present invention can be made without departing from the scope thereof, as defined by the appended claims. For example, in a two-stage muffler, either of the reflector cores may be in the form of a helix while the other is in the form of discrete rings spaced from one another. One core may have one, two or three reflective surfaces independent of the number of reflector surfaces in the other core.

The muffler may be equipped with an additional flow diverter in a two-stage design, similar to the flow diverter shown in FIG. 8, used in a single stage design.

It is not necessary for the first and second stages to be axially aligned with one another. Instead, it is contemplated that, particularly where space is a premium, the second stage may be mounted at an angle up to 90° with respect to the first stage, with the two stages being connected to one another with an elbow.

This novel muffler and insert of the present invention have been described in terms of a generally circular cross section. It is also understood, however, that the benefits of this invention can likewise be realized with mufflers and inserts having other cross-sectional configurations, such as oval and polygonal.

The materials used to fabricate the muffler of this invention are those normally used for muffler construction and are well known to the industry. Typically, galvanized steel, stainless steel and various alloys having resistance to the high temperatures, moisture and chemicals present in the products of combustion can be used.

Although this muffler and insert have been described in connection with their specific use in marine applications, they are also useful with obvious modifications on land vehicles, power equipment, recreation vehicles and other applications where a compact, effective sound attenuator for an internal combustion engine is required or desirable. Other obvious modifications can be made in this muffler and insert without departing from the scope of the invention as defined in the claims.

Having thus defined the invention, the following is claimed:

1. A muffler useful for attenuating the sounds of combustion gases exhausted from an internal combustion engine, said muffler comprising an elongated axially extended housing, an inner chamber, an annular outer chamber radially surrounding said inner chamber, a reflector core separating said inner and outer chambers, the inner chamber including an inlet through which exhaust gases flow into said muffler in an axial direction and at least one frusto-conical flow director for redirecting the flow of exhaust gases from said axial direction to a generally radially outward direction, said reflector core including at least one open passageway for the flow of exhaust gases radially outwardly fore the inner chamber into the outer chamber and at least one planar reflection surface extending into said open passageway at an angle whereby sound waves accompanying the exhaust gases are reflected from said one planar surface back into the inner chamber to cause attenuation of the sound waves.

2. The muffler according to claim 1, wherein said at least one planar reflection surface is positioned radially outwardly of said at least one frusto-conical flow director.

3. The muffler according to claim 2, wherein the inner chamber includes an upstream end and a downstream end, and the frusto-conical flow director closes the downstream end of the inner chamber to divert the flow of exhaust gases radially outwardly into said outer chamber.

4. The muffler according to claim 3, further including at least one annular flow director in the inner chamber spaced upstream from the frusto-conical flow director to redirect a portion of the flow of exhaust gases.

5. The muffler according to claim 4, including a plurality of annular frusto-conical flow directors spaced from one another in the axial direction within the inner chamber, each annular flow director having an annular opening with the annular opening of each flow director being smaller than the annular opening of the next adjacent flow director upstream therefrom.

6. A muffler for attenuating the sounds of exhaust gases emitted from an internal combustion engine, said muffler comprising: a) an elongated, annular housing having a housing axis and including a first end and a second end, an inlet at the first end through which exhaust gases enter the muffler in an axial direction, and an outlet at the second end through which exhaust gases are discharged from the muffler; b) an insert comprising an annular sound reflector core positioned within the housing; c) an inner chamber into which the exhaust gases flow as they enter the muffler; d) an annular outer chamber separated from the inner chamber by said sound reflector core, and defined by the sound reflector core and the annular housing; e) at least one flow director positioned within the inner chamber downstream from the inlet to redirect the direction of flow of the gases; and, f) a passageway through said sound reflector core for the passage of redirected exhaust gases from the inner chamber into the outer chamber, said sound reflector core including (i) a first sound reflecting surface extending into said passageway at an angle which intercepts and reflects at least some of the sound waves back into the inner chamber, and (ii) a second sound reflecting surface extending into said passageway at an angle with respect to said first surface whereby additional sound waves are intercepted and reflected back, said first and second surfaces positioned radially outwardly of said at least one flow director.

7. The muffler according to claim 6, wherein said second sound reflecting surface is positioned radially outwardly of said first sound reflecting surface and extends in a direction that is axially opposite to that of said first sound reflecting surface, said first sound reflecting surface forming an angle no greater than 45° with respect to the housing axis, and the second surface forming an opposite angle between about 25° and about 40° with respect to said housing axis.

8. A muffler useful for attenuating the sounds of combustion gases exhausted from an internal combustion engine, said muffler comprising an elongated axially extended housing having an inlet through which exhaust gases enter the muffler in an axial direction, and an outlet through which the exhaust gases are discharged from the muffler, an inner chamber, an outer chamber radially surrounding said inner chamber and an annular reflector core separating the inner chamber from the outer chamber, the inner chamber containing at least one flow director to redirect the incoming exhaust gases from an axial direction to a radially outwardly direction, the annular reflector core comprising a sound reflector surface positioned radially outwardly of said at least one flow director, forming a helix containing a plurality of loops spaced from one another thereby forming an open passageway between adjacent loops, said sound reflector surface extending into the open passageway at an angle that causes sound waves to reflect from said sound reflector surface back into the inner chamber to cause attenuation of the sound.

9. In a muffler useful for attenuating the sound of an internal combustion engine, said muffler including an axially extending housing having an inlet adapted to be connected to an exhaust pipe in communication with said engine and a gas outlet, the improvement comprising: a) an inner chamber adapted to receive exhaust gases flowing into the muffler in an axial direction through the inlet, at least one deflector within the inner chamber and spaced from the inlet for redirecting the flow of gases from an axial direction to a radially outward direction; b) an annular outer chamber surrounding said inner chamber to receive the radially outwardly flowing gases; c) a reflector core between and separating said inner chamber from said outer chamber, said reflector core comprising a sound reflection surface for reflecting sound waves to cause attenuation of said sound waves as the exhaust gases flow from the inner chamber to the outer chamber, said sound reflection surface comprising a helix having an axis extending in the same axial direction as the axially extending muffler housing, the helix comprising a coil composed of several loops, with each loop spaced from the next adjacent loop to allow for the passage of exhaust gases through the helix from the inner chamber into the outer chamber.

10. In the muffler according to claim 9, said helix comprising a one piece formed annular metal coil made from an elongated flat strip of metal, having a cross-sectional shape comprising first, second and third segments, the second segment having first and second parallel sound reflection surfaces, forming an angle of about 90° with respect to the axis of the helix, said second segment having radially inner and outer ends, the inner end joined to the first segment and forming an acute interior angle therewith of between about 35° and about 55° between the first segment and the first reflective surface, said outer end joined to the third segment and forming an obtuse interior angle of between about 100° and about 150° between said third segment and said second reflective surface.

11. In the muffler according to claim 10, the improvement further comprising spacer means between said reflector core and said housing, said spacer means including a plurality of individual spacers located apart from one another circumferentially around the helix and separating said helix from the housing, each spacer having a first edge in contact with each loop of the helix and a second edge in contact with the housing.

12. In the muffler according to claim 11, said spacer means including first and second annular rings axially spaced from one another, each of said rings containing a slot adapted to receive one end of each spacer.

13. In the muffler according to claim 12, each spacer including a plurality of notches equally spaced along the first edge thereof, with one notch contacting each loop of the helix.

14. In the muffler according to claim 10, said helix being prepared by a) forming a flat elongated strip of metal into the first, second and third segments, and b) coiling the formed elongated strip into a helix containing multiple convolutions spaced from one another to provide a passageway between adjacent loops for exhaust gases.

15. In the muffler according to claim 14, said flat elongated strip being formed into first, second and third segments by roll forming.

* * * * *